United States Patent [19]

Tunks

[11] Patent Number: 4,624,627

[45] Date of Patent: Nov. 25, 1986

[54] SELF-PRIMING PUMP

[76] Inventor: Larry M. Tunks, 16042 Mariner Dr., Huntington Beach, Calif. 92649

[21] Appl. No.: 704,164

[22] Filed: Feb. 22, 1985

[51] Int. Cl.[4] ..... F04B 23/14

[52] U.S. Cl. ..... 417/199 A; 417/201; 417/203

[58] Field of Search ..... 417/199 A, 201, 203, 417/252

[56] References Cited

U.S. PATENT DOCUMENTS

| | | | |
|---|---|---|---|
| 1,927,799 | 9/1933 | Mann | 417/203 |
| 2,500,226 | 3/1950 | Adams | 417/199 A |
| 3,578,880 | 5/1971 | Cygnor | 417/199 A |
| 3,644,061 | 2/1972 | McFarlin | 417/199 A |
| 4,061,439 | 12/1977 | Pech | 417/199 A X |

OTHER PUBLICATIONS

Self-Priming Centrifugal Pumps—Bulletin PP-612C, Pacer Pumps Div. ASM Ind., Leola PA 11/84.

*Primary Examiner*—Richard E. Gluck

*Attorney, Agent, or Firm*—Sheldon & Mak

[57] ABSTRACT

A self-priming pump comprises a casing enclosing first and second impellers rotating on a common shaft. The first impeller in an associated impeller cavity pumps a liquid from an inlet to a first output port. The second impeller in an associated impeller cavity pumps the liquid from the inlet via an intake port to a second output port, the second impeller having a positive displacement for evacuating gas from the first impeller cavity. The first and second output ports are connected to an outlet with means provided for preventing reverse fluid flow into the first output port.

10 Claims, 2 Drawing Figures

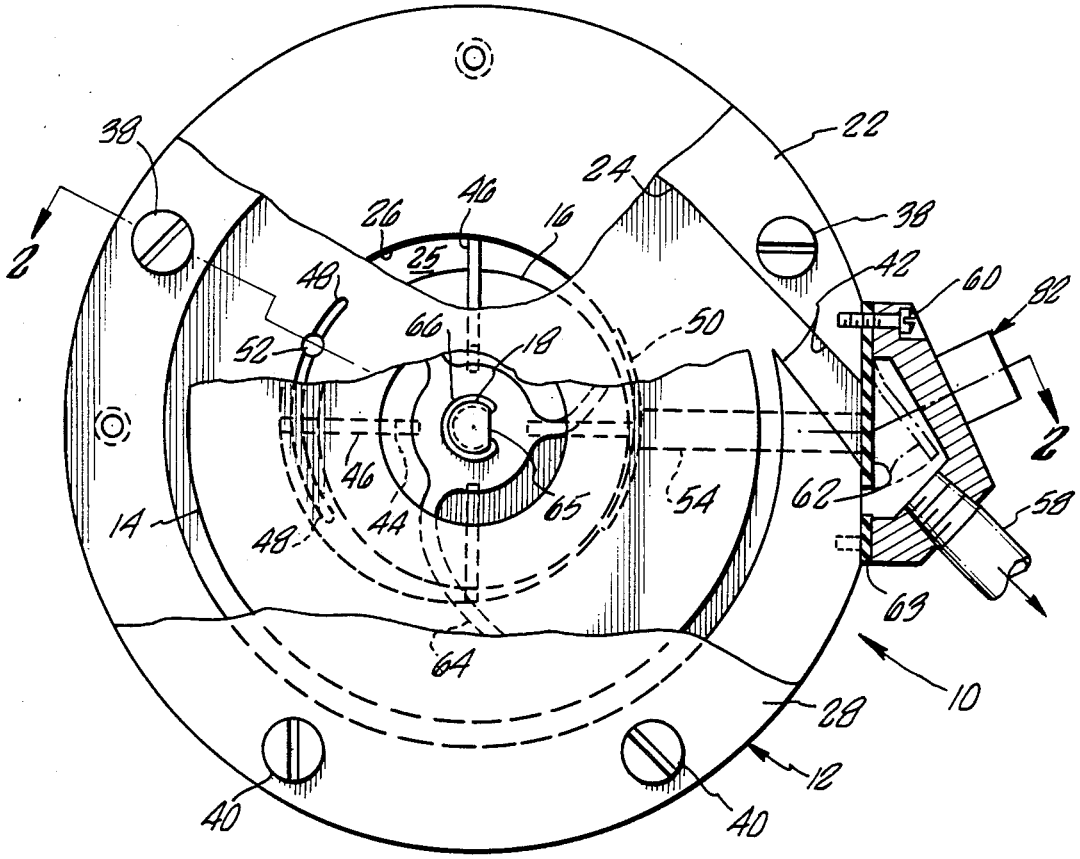
FIG. 1
FIG. 2
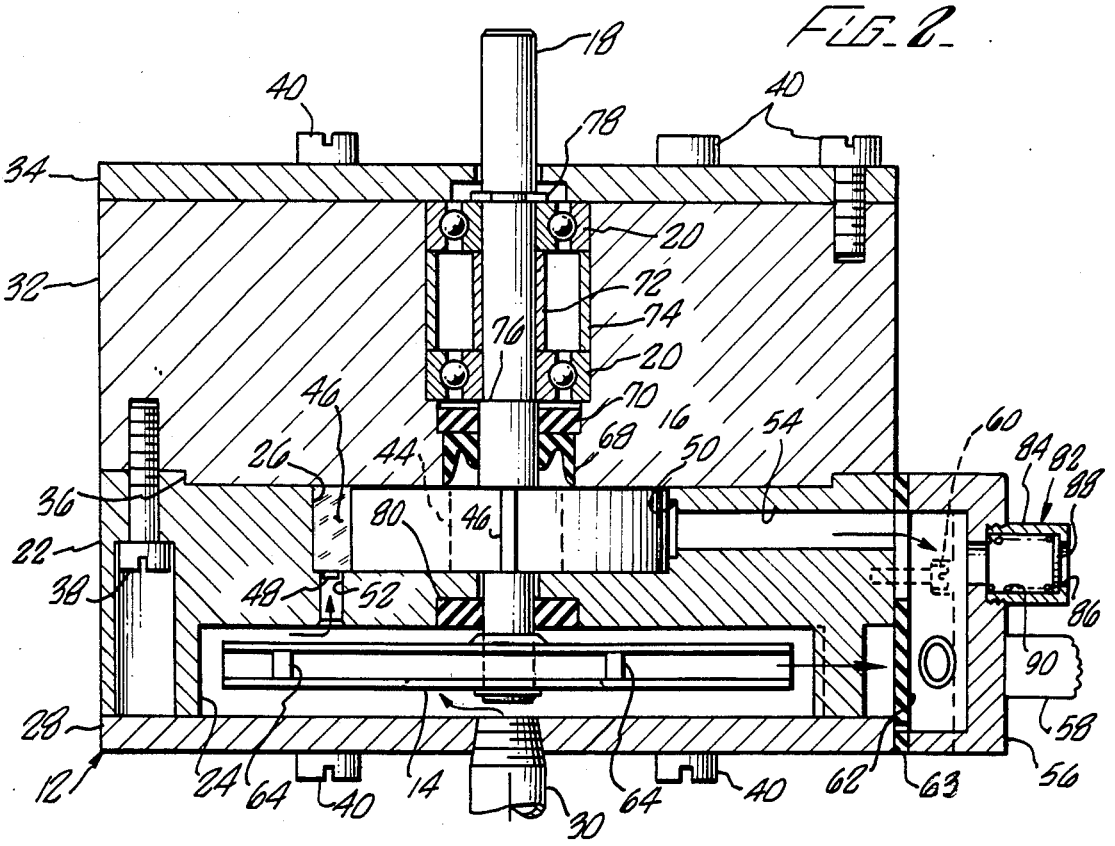

SELF-PRIMING PUMP

BACKGROUND

This invention relates to pumps for liquids, and more particularly to a self-priming pump for swimming pools and the like.

The centrifugal pump is well known as an efficient means for moving large quantities of liquid against a head of moderate pressure. The centrifugal pump comprises a shaft-driven impeller to which liquid is introduced proximate to its rotational axis. Vanes on the rotating impeller urge the liquid outwardly, discharging the liquid at high velocity into a diffuser associated with a casing for the impeller. Liquid pressure is produced by the pump from the centrifugal force produced on the liquid, and by conversion of the dynamic pressure associated with the high velocity into static pressure as the velocity is gradually reduced in the diffuser. A significant limitation of centrifugal pumps, and other pumps that do not provide positive volumetric displacement, is that, when empty, they do not remove air from the suction pipe, but once the air is removed by other means, it is "primed" and pumps normally.

The most common self-priming pump, known as the "wet self-priming pump" has means for traps liquid in the body of the pump. Once the pump has been primed by conventional means, sufficient fluid remains in the body that liquid can be drawn into the pump when it is started from a level a few feet below that of the pump.

The wet self-priming pumps of the prior art suffer from several disadvantages, including:

1. The preliminary priming is awkward and time consuming;
2. Provisions for the preliminary priming are bulky, expensive, and subject to harmful and/or incapacitating air leaks;
3. The self-priming is slow and unreliable, such that the pump may run dry indefinitely;
4. Elaborate, expensive impeller seals are required for significant self-priming capability; and
5. Expensive shaft seals are required to withstand high-temperatures produced during the long periods of dry operation during priming.

Positive displacement pumps such as rotary vane and gear pumps are self-priming to the extent that atmospheric pressure in excess of the liquid vapor pressure is sufficient to raise the liquid level in the suction pipe to the height of the pump. However, they are not as efficient as centrifugal pumps; therefore, they are not generally used for pumping large volumes of a liquid against moderate head of pressure, even when priming is a consideration.

Another disadvantage of many liquid pumps of the prior art is that they are difficult to start after priming, due to the inertia of the liquid column that must be accelerated. Thus expensive, oversized motors and/or special starting provisions are required, with excessive electrical power drain.

Thus there is a need for an efficient, effective self-priming liquid pump that does not require preliminary priming and is easy to start.

SUMMARY

The present invention is directed to a self-priming pump that satisfies this need. The pump comprises a casing enclosing first and second impellers rotating on a common shaft. The first impeller in an associated impeller cavity pumps a liquid from an inlet to a first output port. The second impeller in an associated impeller cavity pumps the liquid from the inlet via an intake port to a second output port, the second impeller having a positive displacement for evacuating gas from the first impeller cavity. The first and second output ports are connected to an outlet with means provided for preventing reverse fluid flow into the first output port.

Upon starting the pump, liquid is drawn up from a reservoir to the inlet by the positive displacement pumping of gas by the second impeller, producing a partial vacuum at the inlet and the first impeller cavity. Once the liquid is drawn into the first impeller cavity, the liquid is pumped to the outlet through both of the output ports.

Preferably the first impeller produces static and dynamic fluid pressure and at least a portion of the dynamic pressure is recovered by means associated with the first impeller cavity. Thus the pump combines the advantages of positive displacement for self-priming and dynamic liquid pumping for high efficiency.

Preferably the means for preventing reverse fluid flow is a flapper valve closing against the first output port, and the connecting means is a manifold covering the output ports and enclosing the flapper valve. The flapper valve, located within the manifold, provides a compact, easily produced pump configuration with minimal restriction of flow from the first output port to the outlet for high efficiency.

Preferably means for draining the pump is included when the pump is idle for easy starting. Thus a small, low cost motor can be used that does not require elaborate starting provisions.

Preferably the intake port receives fluid from the inlet by a passage connected directly to the first impeller cavity for facilitating the evacuation of the gas from the first impeller cavity.

The second impeller can be a rotor having a plurality of vanes sliding in the second impeller cavity and moving with respect to the rotor for conveniently providing the positive displacement of the fluid.

The pump of the present invention is thus effectively reliably primed by the second impeller and efficiently pumps liquid by the first impeller, the pump being automatically primed and easy to start.

DRAWINGS

These and other features, aspects, and advantages of the present invention will become better understood with reference to the following description, appended claims, and accompanying drawings where:

FIG. 1 is a fragmentary front elevational view of the pump of the present invention; and FIG. 2 is a fragmentary plan sectional view of the pump of FIG. 1 taken along line 2—2 in FIG. 1.

DESCRIPTION

The present invention is directed to a self-priming pump for swimming pools and the like. With reference to FIGS. 1 and 2, the pump 10 comprises a casing unit 12, within which rotates a dynamic or centrifugal impeller 14 and a positive displacement impeller or rotor 16. The centrifugal impeller 14 and the rotor 16 can be mounted on a common shaft 18, the shaft 18 being journaled in the casing unit 12 on a pair of bearings 20. The shaft 18 extends from the casing unit 12 for coupling to a suitable drive such as a motor (not shown).

The casing unit 12 includes a casing block 22, having a first impeller cavity 24 for the centrifugal impeller 14, and a second impeller cavity 25, having a second cavity wall 26, for the rotor 16. Also included in the casing unit 12 is an inlet flange 28 covering the first impeller cavity 24. An inlet 30 is mounted to the inlet flange 28 for directing a liquid axially toward the center of the centrifugal impeller 14.

The inlet 30 is intended to be connected by suitable inlet plumbing (not shown) to a vessel containing the liquid. Assuming a liquid level below the inlet 30, the inlet plumbing, as well as the pump 10, initially contains a gas, such as air.

Further components of the casing unit 12 are a bearing block 32, locating the bearings 20 and covering the second impeller cavity 25, and a bearing flange 34 for axially retaining the bearings 20 within the bearing block 32.

The casing block 22 and the bearing block 32 is aligned by a pilot 36, or other suitable means, and sealingly fastened together by casing screws 38. The inlet flange 28 is sealingly fastened to the casing block 22 by a plurality of flange screws 40. The bearing flange 34 is fastened to the bearing block 32 by additional flange screws 40.

The first impeller cavity 24 includes an output port or volute 42 of expanding cross-section for recovering dynamic fluid pressure produced by the centrifugal impeller 14. It should be understood that other means, such as a diffuser (not shown), can be included for the dynamic fluid pressure recovery.

The rotor 16 is provided with four equally spaced slots 44, each of the slots 44 guiding a rotor vane 46 in sliding contact with the second cavity wall 26.

The second impeller cavity 25 is provided with an intake port 48 and an exhaust port 50, the intake port 48 being connected by an intake passage 52 to the first impeller cavity 24, the exhaust port 50 opening into an exhaust passage 54. The second cavity wall 26 is formed eccentrically such that fluid is positively displaced from the intake port 48 to the exhaust port 50 as the rotor 16 rotates.

A manifold 56, having an outlet 58, is sealingly fastened to the casing unit 12 by manifold screws 60, the manifold 56 connecting the volute 42 and the exhaust passage 54 to the outlet 58. A one-way flapper valve 62 is interposed between the volute 42 and the manifold 56 for preventing fluid flow from the exhaust passage 54 into the volute 42, without preventing flow from the volute 42 to the outlet 58. The flapper valve 62 is formed as a portion of a flexible gasket 63, the gasket 63 facilitating sealing of the manifold 56. As shown in the drawings, the outlet 58 is in line with the volute 42. Thus the fluid passing from the volute 42 past the flapper valve 62 to the outlet 58 does not change direction, enhancing the efficiency of the pump 10.

The centrifugal impeller 14 is of conventional design, having centrifugal vanes 64, oriented to direct fluid from the inlet 30 radially outwardly and tangentially when rotated by the shaft 18. Special seals between the centrifugal impeller 14 and the first impeller cavity 24 are not required for self-priming.

It should be understood that any suitable impeller designed for efficient liquid pumping can be substituted for the centrifugal impeller 14, within the scope of the present invention.

Likewise, it is intended that any suitable rotor or impeller designed for efficient evacuation of gas from the inlet plumbing and the first impeller cavity 24 can be substituted for the rotor 16, as long as liquid as well as gas can be freely pumped through the second impeller cavity 25. As shown in the drawings, the second impeller cavity wall 26 is circular, located eccentrically with respect to the shaft 18. The four rotor vanes 46, are equally spaced, 90 degrees apart, as described above. Accordingly, the intake port 48 and the exhaust port 50 are configured to avoid compression of fluid trapped between the rotor vanes 46 by limiting to 90 degrees the angles subtended between the intake port 48 and the exhaust port 50.

The rotor 16 can be an interference fit on the shaft 18, or, as shown in FIG. 2, made integral therewith. The centrifugal impeller 14 can engage the shaft 18 at a D-shaped cylindrical portion 65 thereof, being axially retained thereto by a clip 66.

A cavity seal 68 and a bearing seal 70 is provided in the bearing block for excluding liquid from the bearings 20, the bearings 20 being preferably of anti-friction construction, having inner and outer races separated by a plurality of rolling balls. An inner spacer 72 and an outer spacer 74 is provided between the bearings 20, the inner races thereof being confined between a shoulder 76 and a clip 78 for reducing radial play of the shaft 18. A nonmetallic auxiliary bearing 80 is provided in the casing block 22 between the first impeller cavity 24 and the second impeller cavity 25 for further support of the shaft 18 and for sealing the shaft 18.

Alternatively, one of the bearings 20 can be located in the casing block 22 between the first impeller cavity 24 and the second impeller cavity 25, facilitating rigid radial positioning of the shaft 18. Appropriate seals can be provided for excluding the liquid from both sides of the bearing 20.

The cavity seal 68, the bearing seal 70, and the auxiliary bearing 80 can be of conventional design because priming occurs quickly and reliably, producing effective liquid cooling. Thus the expensive ceramic seals that are used in the wet self-priming pumps of the prior art are not required in the present invention.

Preferably the self-priming pump 10 is equipped with a drain vent 82 for admitting gas to the first impeller cavity 24 and the second impeller cavity 25, following periods of use. Thus, when subsequently restarted, there is only slight resistance to full speed rotation of the shaft 18. Consequently, the shaft 18 can be driven by a small, inexpensive motor not requiring elaborate starting provisions.

The drain vent 82 can be conveniently mounted to the manifold 56 proximate to the exhaust passage 54 for quickly admitting the gas to the second impeller cavity 25. The drain vent 82 comprises a cylindrical valve body 84 having a vent port 86, the vent port 86 being covered internally by a disk 88. The disk 88 is lightly biased against the vent port 86 by a spring 90 so that, when a partial vacuum is present in the manifold 56, gas enters the vent port 86, passing the disk 88, and entering the manifold 56.

When the pump 10 is stopped, the weight of liquid in the inlet plumbing causes a partial vacuum to be produced in the manifold 56 as the liquid seeps past the rotor vanes 46, through the intake passage 52 to the inlet 30. The partial vacuum in the manifold 56 causes the disk 88 to move away from the drain port 86, collapsing the spring 90 and admitting air to the manifold 56. Once the air reaches the second impeller cavity 25 and the rotor vanes 46, the rate of seepage increases, rapidly draining the second impeller cavity 25 and the first impeller cavity 24 through the inlet 30. Thus the pump 10, automatically drained of liquid, can easily be restarted.

In operation, the gas initially present in the inlet plumbing is drawn through the inlet 30, the intake passage 52 and the intake port 48, being positively displaced through the exhaust port 50, the exhaust passage 54, and the manifold 56, to the outlet 58. The gas is prevented from recirculating to the first impeller cavity 24 by the flapper valve 62. A partial vacuum is created in the inlet plumbing, ambient pressure in the vessel causing the liquid to be drawn into the first impeller cavity 24.

When the liquid reaches the centrifugal impeller 14, it is pumped to the volute 42, the flapper valve 62 opening when the pressure within the volute 42 exceeds the pressure in the manifold 56. As pumping continues, the remaining gas is expelled as bubbles from both the first impeller cavity 24 and the second impeller cavity 25, the gas passing through the volute 42 as well as the exhaust passage 54 to the outlet 58, the pump 10 becoming completely primed.

Once primed, the pump 10 continues liquid delivery through both the volute 42 and the exhaust passage 54, both the centrifugal impeller 14 and the rotor vanes 46 contributing to the total flow.

The pump 10 is tolerant of air leak conditions in the inlet plumbing in that the rotor 16 continues to positively displace fluid after priming. Thus liquid flow is not interrupted so long as air leakage is limited to a rate less than the volumetric rate of the rotor 16 in the second impeller cavity 25.

Preferably the majority of the liquid is pumped by the centrifugal impeller 14 for high overall efficiency of the pump 10. Consequently, the rotor 16 and the second impeller cavity 25 are preferably designed to produce only enough fluid flow for reliable and reasonably quick priming.

The pump of the present invention is thus automatically self priming and compact, not requiring the bulky and unreliable preliminary priming provisions of the prior art. The pump is inexpensive to produce in that ordinary seals can be used, and it is easy to start with a small motor because the pump is automatically drained following each use.

Although the present invention has been described in considerable detail with regard to certain versions thereof, other versions are possible. Therefore, the spirit and scope of the appended claims should not be limited to the description of the versions contained herein.

What is claimed is:

1. A self-priming pump comprising:

(a) a casing comprising:
  (i) a first impeller cavity having an inlet and a first output port;
  (ii) a second impeller cavity having an intake port and a second output port; and
  (iii) means permitting fluid to flow from the inlet to the intake port;

(b) a first impeller in the first impeller cavity for pumping a liquid from the inlet to the first output port;

(c) a second impeller in the second impeller cavity for pumping the liquid from the intake port to the second output port, the second impeller having a positive displacement for evacuating gas from the first impeller cavity;

(d) a shaft for rotating the first impeller and the second impeller;

(e) a manifold for connecting the first and second output ports to an outlet; and (f) a flapper valve for preventing fluid flow from the connecting means to the first output port, the flapper valve moving within the manifold and closing against the first output port.

2. The pump of claim 1 wherein the first impeller produces static and dynamic fluid pressure and the first impeller cavity includes means for recovering at least a portion of the dynamic fluid pressure for efficiently pumping the liquid.

3. The pump of claim 2 wherein the the outlet, the first output port, and the recovery means are aligned for permitting the fluid to flow from the recovery means to the outlet without changing direction.

4. The pump of claim 1 including automatic means for venting gas into the pump when the pump is stopped for rapidly draining the pump for reducing the power required in re-starting the pump.

5. The pump of claim 1 wherein the permitting means is a passage from the first impeller cavity to the intake port.

6. The pump of claim 1 wherein the second impeller comprises a rotor having a plurality of vanes, the vanes slidingly engaging the second impeller cavity and moving with respect to the rotor.

7. The pump of claim 6 wherein the rotor has a plurality of slots for guiding the vanes.

8. A self-priming pump comprising:

(a) a casing comprising:
  (i) a first impeller cavity having an inlet and a first output port;
  (ii) a second impeller cavity having an intake port and a second output port; and
  (iii) a passage from the first impeller cavity to the intake port for permitting fluid to flow from the inlet to the second impeller cavity;

(b) a first impeller in the first impeller cavity for pumping the liquid from the inlet to the first output port, the first impeller producing static and dynamic fluid pressure;

(c) a slotted rotor in the second impeller cavity;

(d) a shaft for rotating the first impeller and the slotted rotor;

(e) a plurality of vanes guided by the slotted rotor, the vanes slidingly engaging the second impeller cavity, for positively displacing the liquid from the intake port to the second output port, for evacuating gas from the first impeller cavity;

(f) a manifold connecting the first output port and the second output port, the manifold having an outlet; and (g) a flapper valve movable within the manifold for preventing fluid flow from the manifold to the first output port, wherein the first impeller cavity includes means for recovering at least a portion of the dynamic fluid pressure for efficiently pumping the liquid.

9. The pump of claim 1 further comprising a gasket for sealing the manifold to the casing, the gasket forming the flapper valve.

10. The pump of claim 4 wherein the venting means comprises a one-way valve, the one-way valve permitting gas to enter the manifold when a partial vacuum is present in the manifold.

* * * * *